US009653849B2

(12) United States Patent
Hsu et al.

(10) Patent No.: US 9,653,849 B2
(45) Date of Patent: May 16, 2017

(54) ELECTRICAL CONNECTOR HAVING GOOD ANTI-EMI PERFPRMANCE

(71) Applicant: FOXCONN INTERCONNECT TECHNOLOGY LIMITED, Grand Cayman (KY)

(72) Inventors: Kuo-Chun Hsu, New Taipei (TW); Chun-Sheng Li, Kunshan (CN); Jian-Kuang Zhu, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,972

(22) Filed: Jul. 29, 2016

(65) Prior Publication Data

US 2017/0033506 A1 Feb. 2, 2017

(30) Foreign Application Priority Data

Jul. 29, 2015 (CN) ..... 2015 2 0554210

(51) Int. Cl.

| | |
|---|---|
| ***H01R 13/648*** | (2006.01) |
| ***H01R 13/6584*** | (2011.01) |
| ***H01R 13/405*** | (2006.01) |
| ***H01R 13/629*** | (2006.01) |
| *H01R 13/6585* | (2011.01) |
| *H01R 12/50* | (2011.01) |

(52) U.S. Cl.

CPC ..... *H01R 13/6584* (2013.01); *H01R 13/405* (2013.01); *H01R 13/629* (2013.01); *H01R 13/6585* (2013.01); *H01R 23/688* (2013.01)

(58) Field of Classification Search

CPC ..... H01R 23/688; H01R 13/6585
USPC ..... 439/607.34, 607.55
See application file for complete search history.

(56) References Cited

U.S. PATENT DOCUMENTS

| | | | | |
|---|---|---|---|---|
| 8,337,249 | B2 * | 12/2012 | Lappoehn | H01R 23/6873 439/607.4 |
| 8,808,029 | B2 * | 8/2014 | Castillo | H01R 13/6585 439/607.05 |
| 2015/0072546 | A1 * | 3/2015 | Li | H01R 13/6585 439/96 |

(Continued)

*Primary Examiner* — Tho D Ta
(74) *Attorney, Agent, or Firm* — Wei Te Chung; Ming Chieh Chang

(57) ABSTRACT

An electrical connector includes an insultive housing and a terminal module retained in the insultive housing. The insultive housing defines an upper sidewall, a lower sidewall opposite to the upper sidewall and a pair of end walls connected with the upper and lower sidewalls, which together form a receiving cavity, each end wall defines a recess communicating with the receiving cavity. The terminal module defines a first module, a second module and a shielding member located between the first module and the second module. The shielding member is an integrated structure and defines a shielding portion, a plurality of elastic contacting arms projecting forwardly from the shielding portion and extending laterally, and a pair of locking portions bending into the corresponding recesses from the opposite sides of the shielding portion, the elastic contacting arms and the locking portions are exposed into the receiving cavity of the insulative housing.

17 Claims, 10 Drawing Sheets

(56) References Cited

U.S. PATENT DOCUMENTS

| | | | | |
|---|---|---|---|---|
| 2016/0013595 | A1* | 1/2016 | Kao | H01R 13/6591<br>439/607.55 |
| 2016/0049752 | A1 | 2/2016 | Qian et al. | |

* cited by examiner

ELECTRICAL CONNECTOR HAVING GOOD ANTI-EMI PERFPRMANCE

BACKGROUND OF THE INVENTION

1. Field of the Invention

The present invention relates to an electrical connector, and more particularly to an electrical connector having a good anti-EMI performance. This invention is related to a copending application Ser. No. 15/222,974 disclosing the mated connectors, filed on the same day and having the same inventors and the same assignee with the instant invention.

2. Description of the Related Art

With the development of technology, a series of electrical connectors are very popular which are used for transmitting high-frequency signals and have a good anti-EMI performance. One of the electrical connectors includes a shell formed of a polymeric material, a pair of terminal modules and a shielding plate assembled into the shell. The shell is directly injection molded on the terminal modules to form a mating portion having a pair of mating surfaces opposite to each other, each of the terminal modules defines a plurality of conductive terminals exposed on the corresponding mating surface and an insulative block injection molded on the conductive terminals. The shielding plate is disposed between the pair of terminal modules and spaced apart from the conductive terminals by the insulative block so as to not contact with the conductive terminals, which can effectively prevent electromagnetic interference of the conductive terminals. However, with the development needs of high-frequency transmission, the signal interference between the conductive terminals becomes increasingly serious.

Therefore, an improved electrical connector is highly desired to meet overcome the requirement.

BRIEF SUMMARY OF THE INVENTION

An object of the present invention is to provide an electrical connector having a stable structure and a good electromagnetic shielding effect.

In order to achieve above-mentioned object, an electrical connector includes an insultive housing and a terminal module retained in the insultive housing. The insultive housing defines an upper sidewall, a lower sidewall opposite to the upper sidewall and a pair of end walls connected with the upper and lower sidewalls, which together form a receiving cavity, each end wall defines a recess communicating with the receiving cavity. The terminal module defines a first module, a second module and a shielding member located between the first module and the second module. The shielding member is an integrated structure and defines a shielding portion, a plurality of elastic contacting arms projecting forwardly from the shielding portion and extending laterally, and a pair of locking portions bending into the corresponding recesses from the opposite sides of the shielding portion, the elastic contacting arms and the locking portions are exposed into the receiving cavity of the insulative housing.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
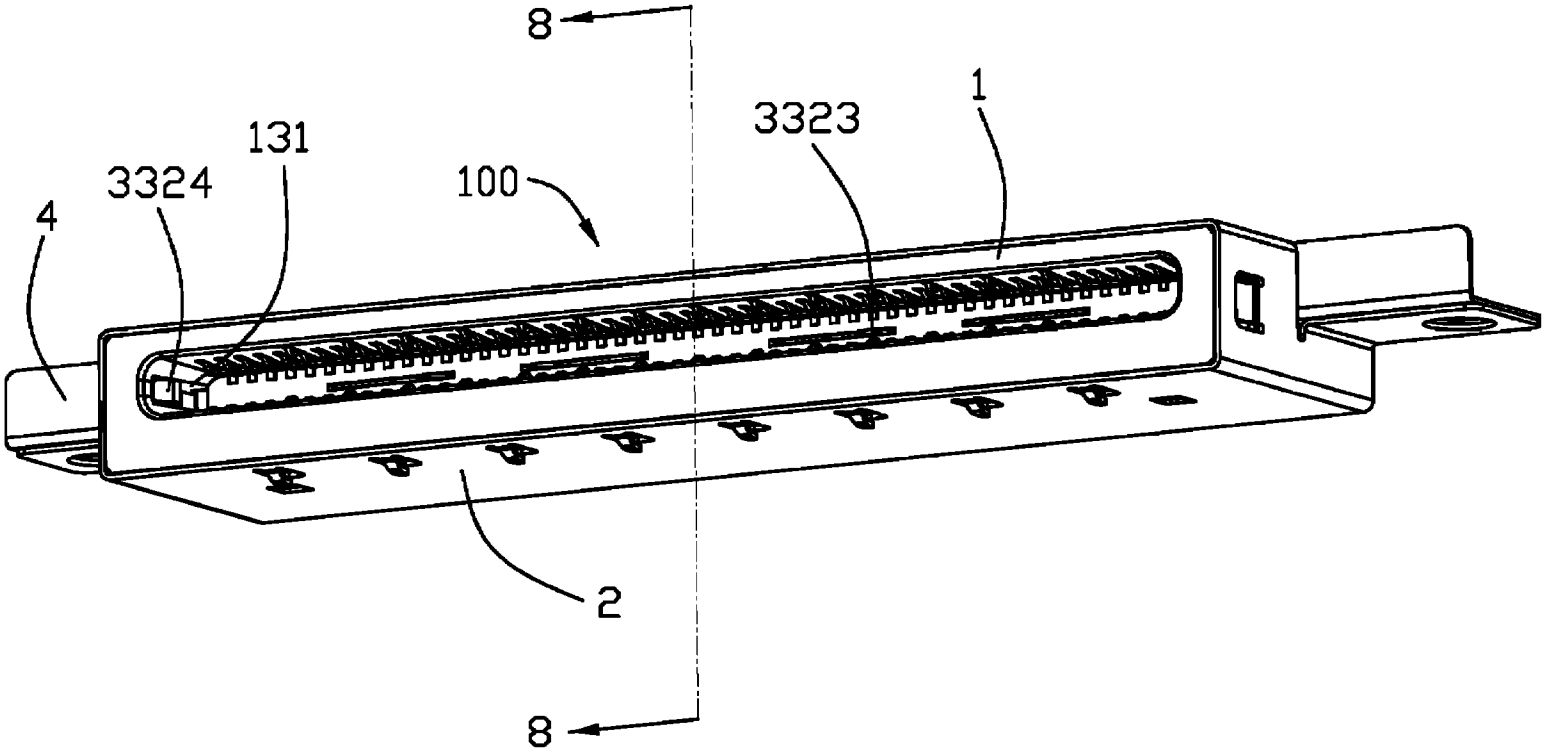
FIG. 1 is a perspective view showing an electrical connector in accordance with the present invention.
Figure 2:
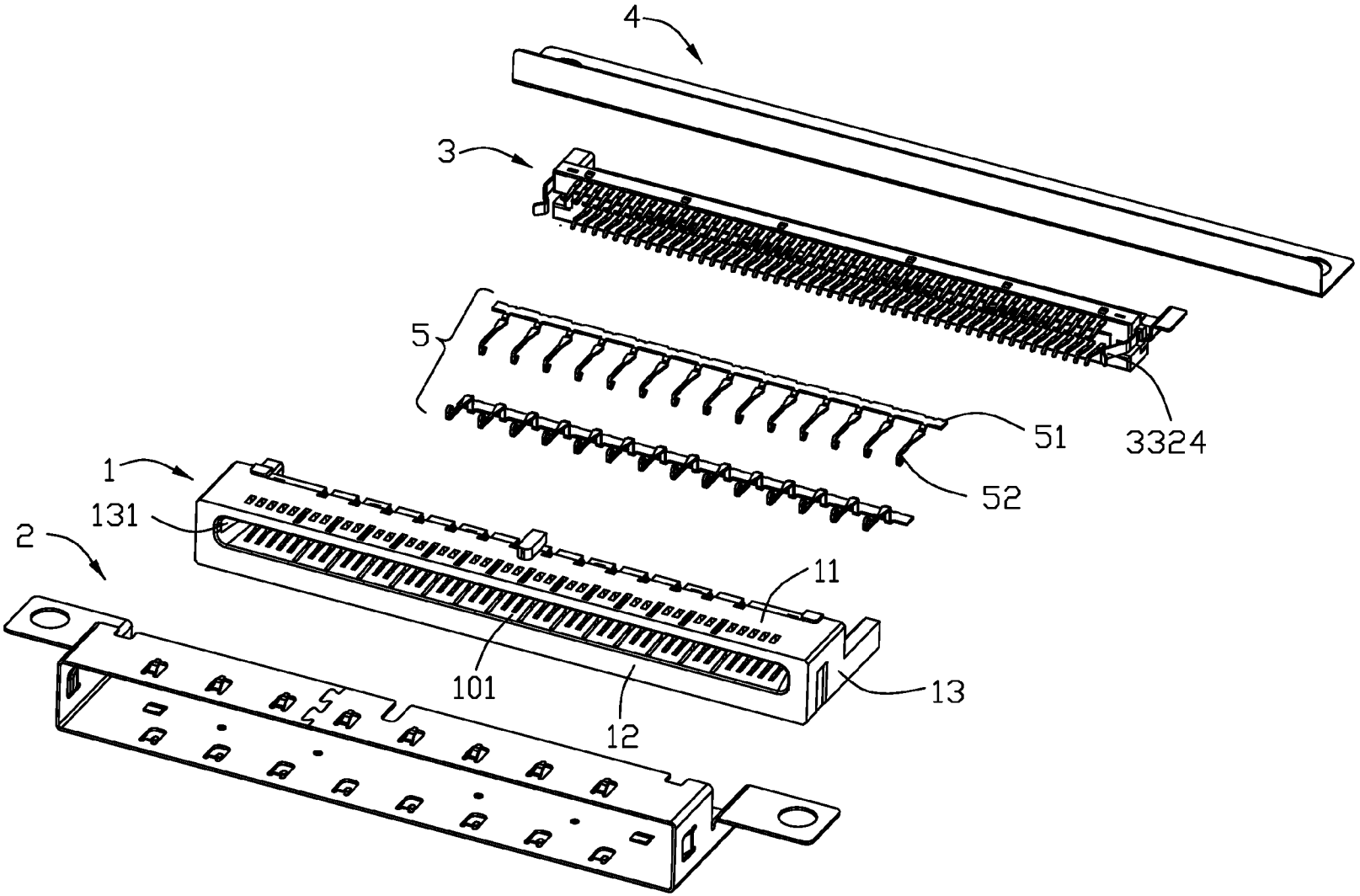
FIG. 2 is a partly exploded perspective view of the electrical connector shown in FIG. 1.
Figure 3:
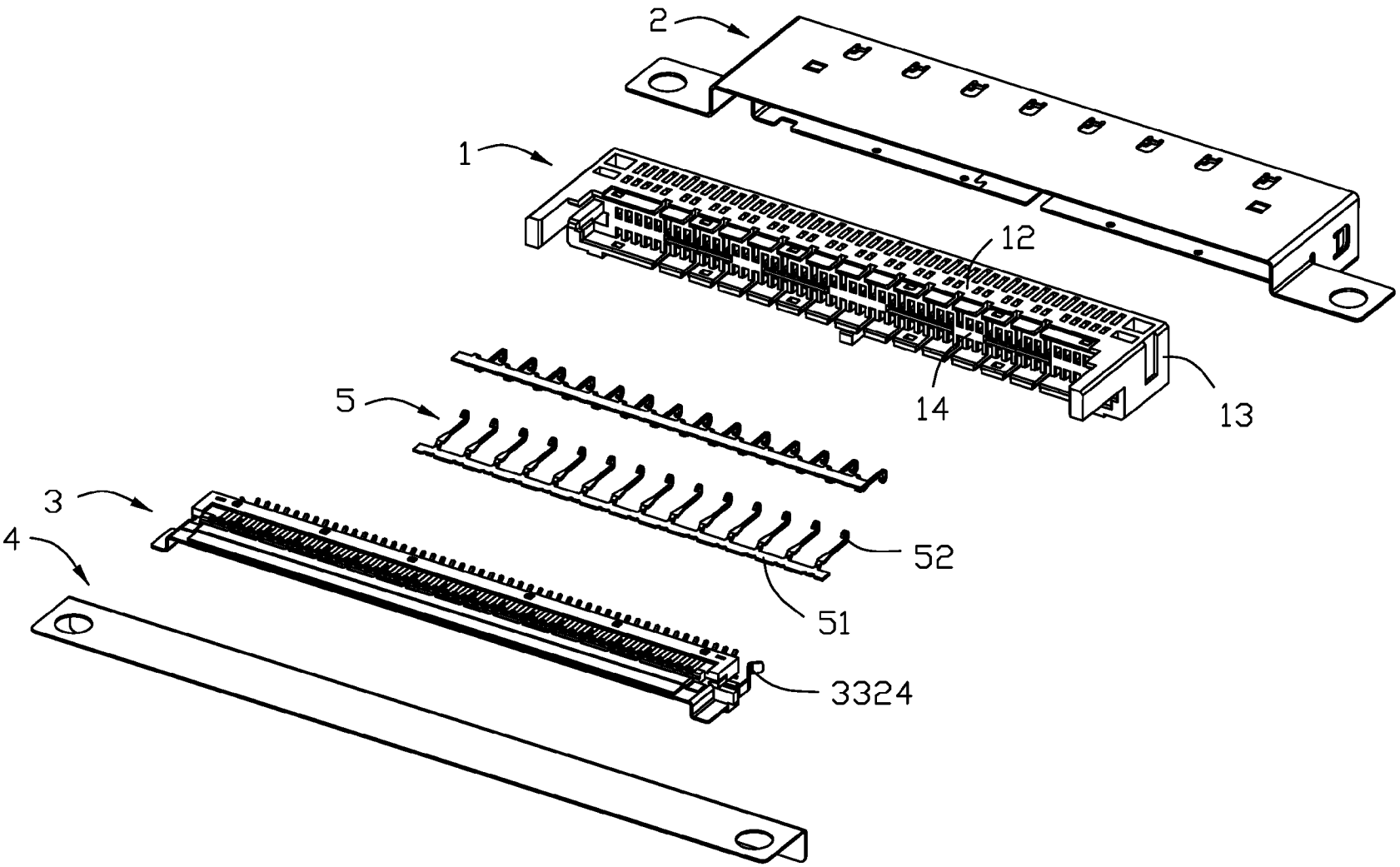
FIG. 3 is another partly exploded perspective view of the electrical connector shown in FIG. 1.

Reference will now be made to the drawing figures to describe a preferred embodiment of the present invention in detail. Referring to FIG. 1 to FIG. 3, an electrical connector 100 is preferably a receptacle to be mounted to an electronic device for a corresponding mating connector inserted. The electrical connector 100 includes an elongated insulative housing 1, a metal shell 2 surrounding the insulative housing 1 and a terminal module 3 assembled into the insulative housing 1. The insulative housing 1 defines an upper sidewall 11, a lower sidewall 12 opposite to the upper sidewall 11 and a pair of end walls 13 connected with the upper sidewall 11 and the lower sidewall 12. The upper sidewall 11, the lower sidewall 12 and the end walls 13 together form a receiving cavity 101 for the corresponding mating connector inserted, and each end wall 13 defines a recess 131 communicating with the receiving cavity 101. The upper sidewall 11 and the lower sidewall 12 form a plurality of passageways (not labeled) for receiving the contacting portions of the terminals which will be illustrated later.

Figure 4:
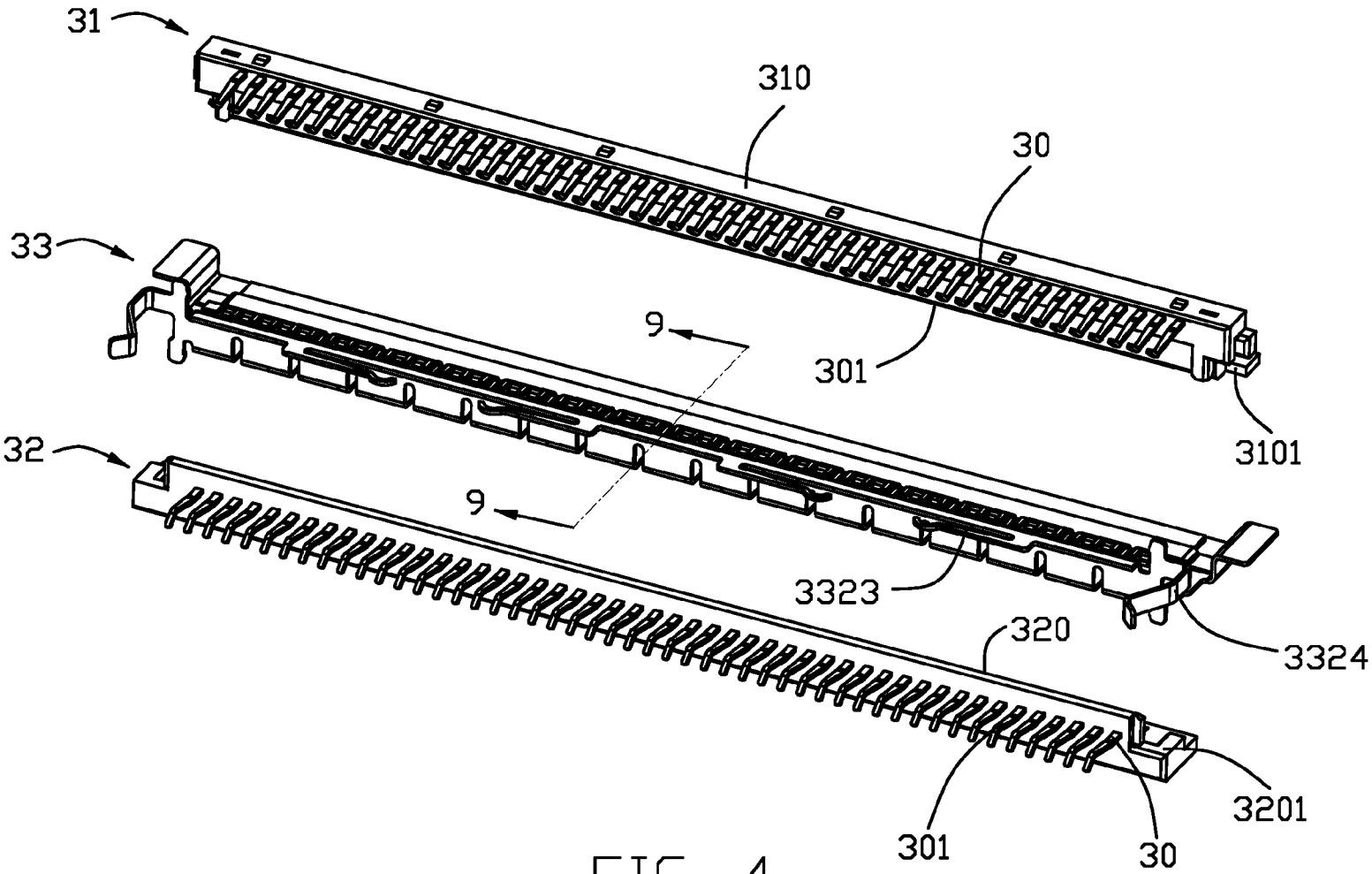
FIG. 4 is a partly exploded perspective view of a terminal module of the electrical connector shown in FIG. 2.
Figure 5:
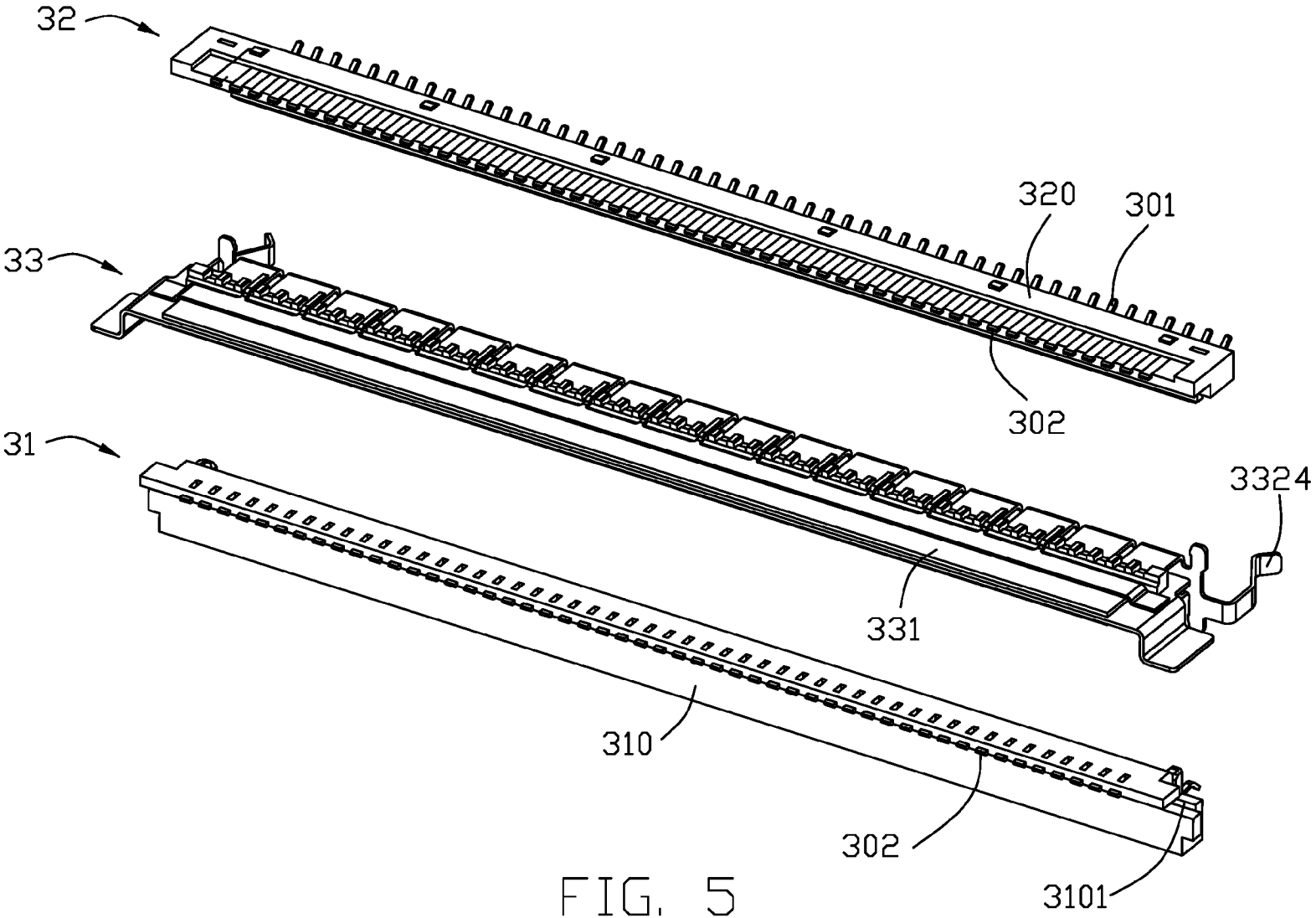
FIG. 5 is a partly exploded perspective view of a terminal module of the electrical connector shown in FIG. 3.
Figure 8:
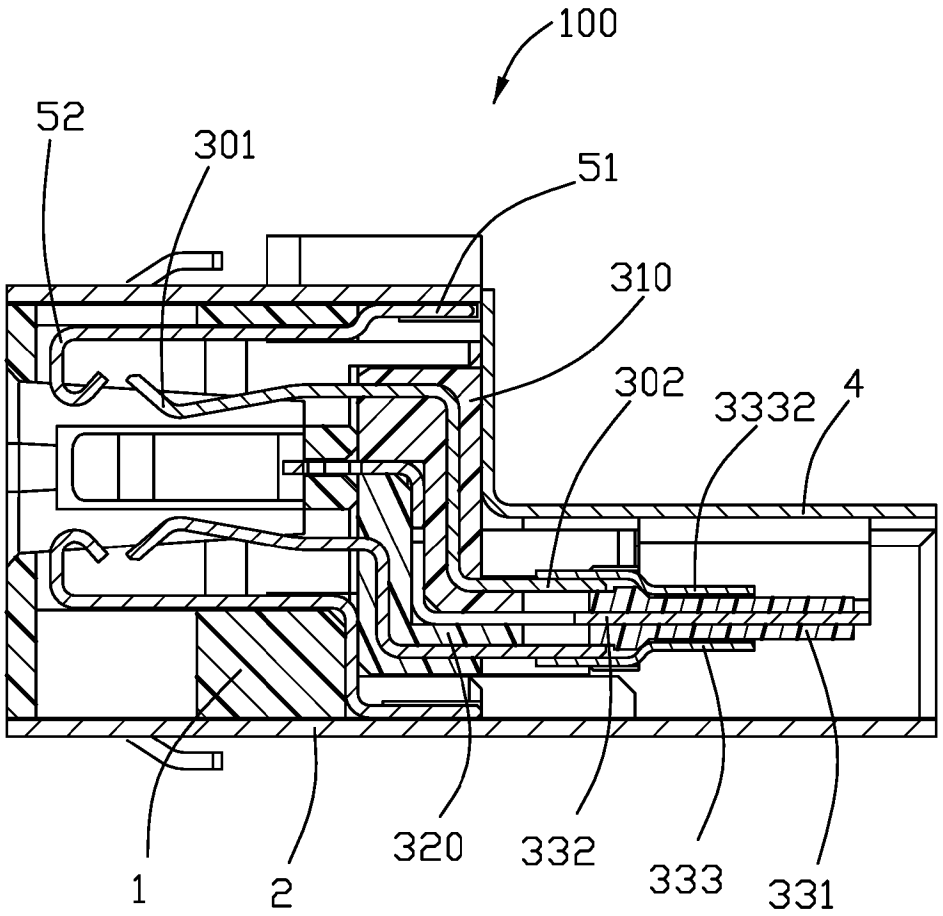
FIG. 8 is a cross-sectional view of the electrical connector taken along line 8-8 shown in FIG. 1.

Referring to FIG. 4 to FIG. 5 and FIG. 8, the terminal module 3 is assembled to the rear sidewall 14 of the insulative housing 1 and includes a first/upper module 31 and a second/lower module 32 separated from each other in a vertical direction, and a third module 33 located between the first module 31 and the second module 32. The first module 31 includes a plurality of upper conductive terminals 30 and a Z-shaped first insulative block 310 injection molded on the conductive terminals 30, and the second module 32 includes a plurality of lower conductive terminals 30 and an L-shaped second insulative block 320 injection molded on the conductive terminals 30, whereby the conductive terminals 30 are secured together better.

The terminals include the grounding terminals and the differential pair signal terminals alternately arranged with each other in the transverse direction. Each conductive terminal 30 defines a connecting portion retained in the insulative block, a resilient contact portion 301 extending forwardly from the connecting portion and exposed in the receiving cavity 101, and a tail portion 302 extending outside of the insulative housing 1 from the connecting portion. The first insulating block 310 defines a pair of first mating portions 3101 located on the both sides thereof and the second insulating block 320 defines a pair of second mating portions 3201 located on the two sides thereof, the first mating portions 3101 and the second mating portions 3201 are cooperating with each other so as to clamp the third module 33 to form the terminal module 3.

Figure 6:
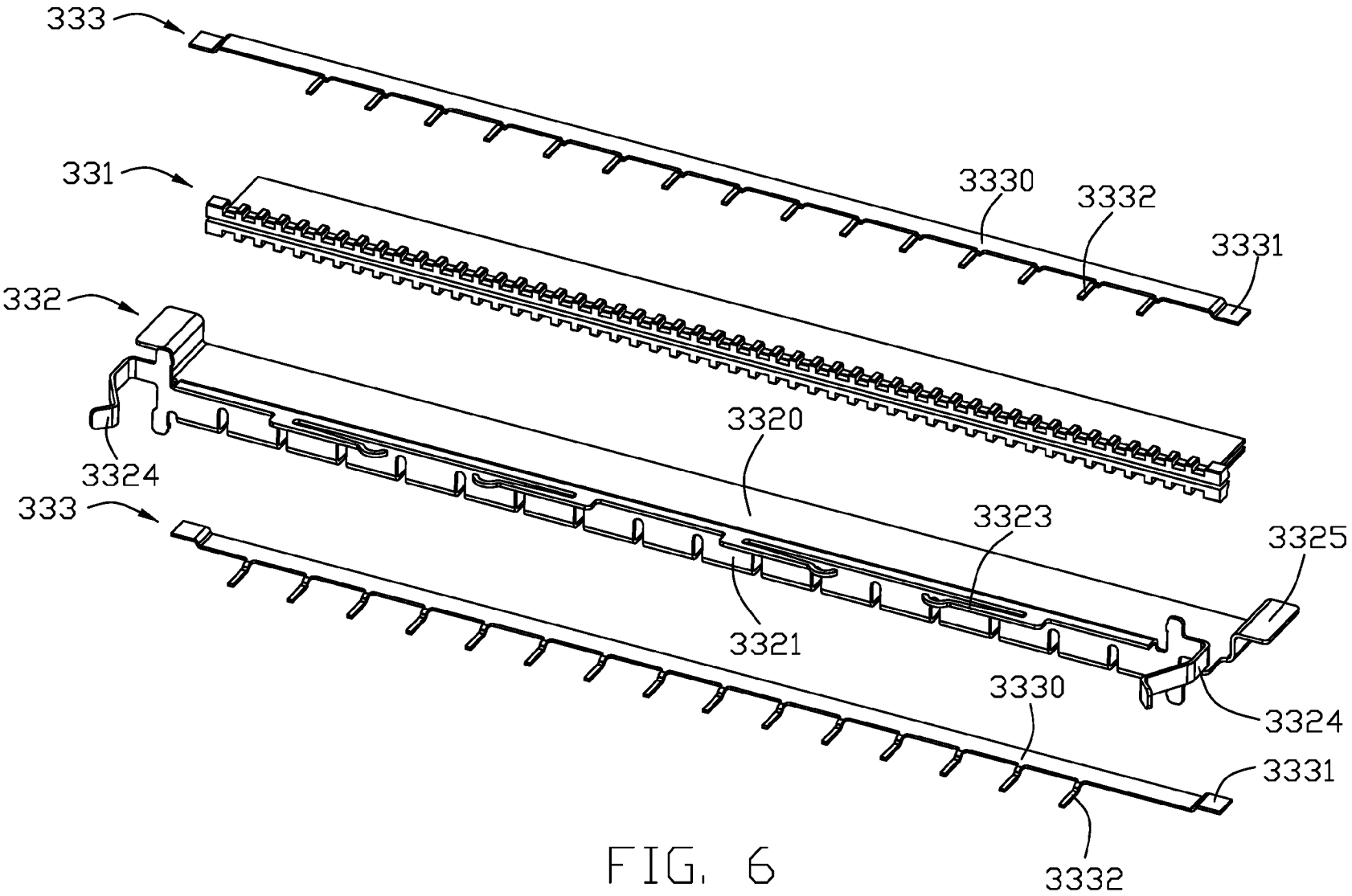
FIG. 6 is an exploded perspective view of a third module of the terminal module shown in FIG. 4.
Figure 7:
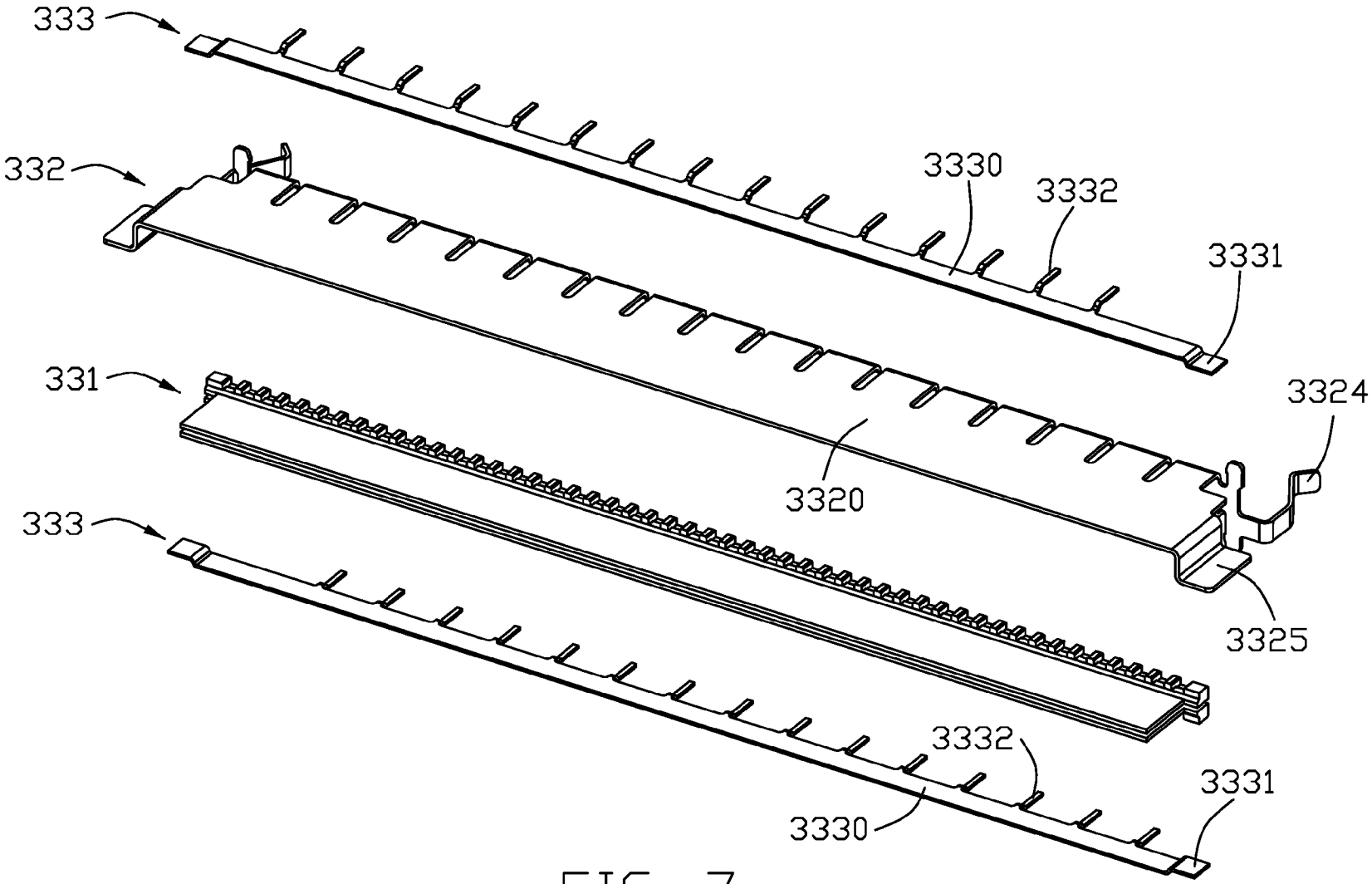
FIG. 7 is an exploded perspective view of a third module of the terminal module shown in FIG. 5.
Figure 9:
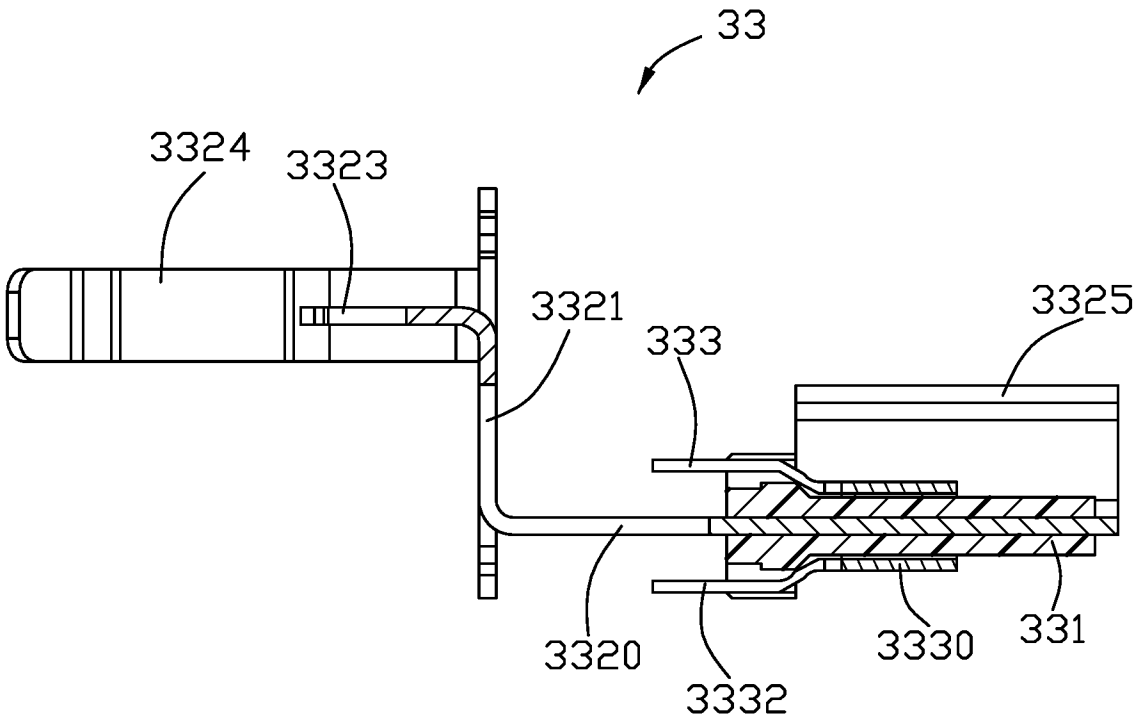
FIG. 9 is a cross-sectional view of a third module of the terminal module taken along line 9-9 shown in FIG. 4.

Referring to FIG. 6 to FIG. 7 and FIG. 9, the third module 33 includes a third insulative block 331, a shielding member 332 retained in the third insulative block 331 and a pair of grounding plates 333 assembled to the outsides of the third insulative block 331. The shielding member 332 is an integrated structure and defines a horizontal shielding portion 3320, a vertical shielding portion 3321 extending upwardly from the front of the horizontal shielding portion 3320, a plurality of elastic contacting arms 3323 projecting horizontally from the top of the vertical shielding portion 3321 and extending laterally, and a pair of locking portions 3324 bending forwardly from the opposite sides of the vertical shielding portion 3321. The third insulative block 331 is directly injection molded on the rear end of the horizontal shielding portion 3320 of the shielding member 332 in a self-symmetrical arrangement, i.e., the mirror images, with regard to the horizontal shielding portion 3320 in the vertical direction. The first module 31 and the second module 32 are mounted on the front end of the horizontal shielding portion 3320 and disposed in front of the third insulative block 331. When the electrical connector 100 is assembling, the elastic contacting arms 3323 of the shielding member 332 are running through the rear sidewall 14 of the insulative housing 1 and exposed in the receiving cavity 101, the locking portions 3324 are inserted in the end walls 13 via the rear end of the insulative housing 1 so as to be accommodated in the corresponding recesses of the end walls 13 and partially exposed to the receiving cavity 101. It is convenient to overlap between the shielding member 332 and the grounding members of the mating connector, thereby forming a better shielding effect.

Each of the grounding plates 333 defines an elongated body portion 3330, a plurality of connecting arms 3332 extending forwardly from the body portion 3330 and a pair of soldering portions 3331 bent and extending from both sides of the body portion 3330. The body portion 3330 is attached to the outside of the third insulating block 331, the soldering portions 3331 are soldered on the horizontal shielding portion 3320 of the shielding member 332 by a manner, such as soldering or spot-welding, to fix the grounding plate 333. And the plurality of the connecting arms 3332 are used for overlapping the tail portions 302 of some conductive terminals 30 of the first and second modules to form grounding terminals.

The electrical connector 100 further includes two grounding bars 5 and a shielding plate 4 assembled to the insulative housing 1. Each grounding bar 5 defines a longitudinal base portion 51 and a plurality of resilient arms 52, the base portions 51 of two grounding bars 5 are attached to outer surfaces of the upper sidewall 11 and the lower side wall 12, respectively, and the resilient arms 52 are extending into the corresponding upper and lower sidewalls of the insulative housing 1 from the base portion 51. After the electrical connector 100 is assembled, the contacting end of the resilient arm 52 is exposed in the receiving cavity 101 and located in front of the contacting portion 301 of the grounding terminal of the conductive terminal 30, and the base portion 51 of the grounding bar 5 is also connected to the metal shell 2. The shielding plate 4 is assembled to the rear end of the insulative housing 1 and the metal shell 2, and the shielding plate 4 is contacting with the metal shell 2 and the soldering plates 3325 of the shielding member 332, thereby forming a better shielding effect.

It is advantageous to reduce signal interference between two rows of the conductive terminals 30 to providing the shielding member 332, thereby improving the electrical performance of the electrical connector 100. The shielding member 332 is an integrated structure, wherein the elastic contacting arms 3323 are exposed to the receiving cavity 101 from the rear sidewall 14 of the insulative housing 1 and the locking portions 3324 are exposed to the receiving cavity 101 from the end walls 13 of the insulative housing 1, so that the shielding member 332 can engage with the contacting member of the mating connector when the electrical connector is engaged with the mating connector, which plays a role in the elimination of static electricity and further improves the electrical performance of the electrical connector 100. While the two grounding bars 5 are overlapping the metal shell 2 and the resilient arms 52 are located in front of the contacting portions 301 of the grounding terminals of the conductive terminals 30, so that the grounding bars 5 can engage with the contacting member of the mating connector when the electrical connector is engaged with the mating connector, which plays a role in the electromagnetic shielding to the grounding terminals and further improves the electrical performance of the electrical connector 100. In brief, the grounding bars 5 are not directly connected to the correspond grounding contacts while the grounding plates 333 are directly connected to the corresponding grounding contacts.

From the above description in the present embodiment, a method of manufacturing the electrical connector 100 may have the following steps:

(a). providing a shielding member 332, the shielding member 332 defines a horizontal shielding portion 3320, a vertical shielding portion 3321 extending upwardly from the front of the horizontal shielding portion 3320, a plurality of elastic contacting arms 3323 projecting horizontally from the top of the vertical shielding portion 3321 and extending laterally, and a pair of locking portions 3324 bending forwardly from the opposite sides of the vertical shielding portion 3321; a third insulative block 331 is directly injection molded on the horizontal shielding portion 3320 of the shielding member 332;

(b). providing two rows of conductive terminals 30, a pair of insulative blocks are respectively injection molded on the two rows of conductive terminals 30 to form a first module 31 and a second module 32, each conductive terminal 30 defines a contacting portion 301 extending forwardly and outside of the insulative block;

(c). the first module 31 and the second module 32 are assembled to opposite sides of the front portion of the horizontal shielding portion 3320 and fixed together by the locking portions of the first and second modules;

(d). providing two grounding plates 333, the grounding plate 333 are mounted on the opposite sides of the third insulating block 331, and the soldering portions 3331 of the grounding plate 333 are welded on the horizontal shielding portion 3320 of the shielding member 332, respectively, to form a terminal module 3; while the connecting arms 3332 of the two grounding plates 333 are attached to the tail portions 302 of the grounding terminals of the conductive terminals 30;

(e). providing an insulative housing 1, the insulative housing 1 defines a receiving cavity 101 and a pair of recesses 131 located in the end walls 13 and communicating with the receiving cavity 101, the terminal module 3 is assembled to the rear sidewall 14 of the insulative housing 1, the contacting portions 301 of the conductive terminals 30 and the elastic contacting arms 3323 of the shielding member are running through the rear sidewall 14 and exposed in the receiving cavity 101, and the locking portions 3324 of the shielding member 332 are received into the recesses 131 of the end walls 13 and projecting into the receiving cavity 101;

(f). providing two grounding bars 5, the base portions 51 of the ground bars 5 are attached to the upper and lower sidewalls of the insulative housing 1, respectively, the resilient arms 52 of the grounding bars 5 are extending into the receiving cavity from the base portions 51 and the contacting ends of the resilient arms 52 are located in front of the grounding terminals of the terminals module;

(g). providing a metal shell 2, the metal shell 2 is covering the outside of the insulative housing 1 and contacting with the base portions 51 of the grounding bars 5;

(h). providing a shielding plate 4, the shielding plate 4 is assembled to the rear end of the insulative housing 1 and the metal shell 2 to form the electrical connector 100, wherein the shielding plate 4 is contacting with the metal shell 2 and the soldering plates of the shielding member 332. The method of manufacturing the electrical connector 100 makes the electrical connector 100 having a good anti-electromagnetic interference effect.

Figure 10:
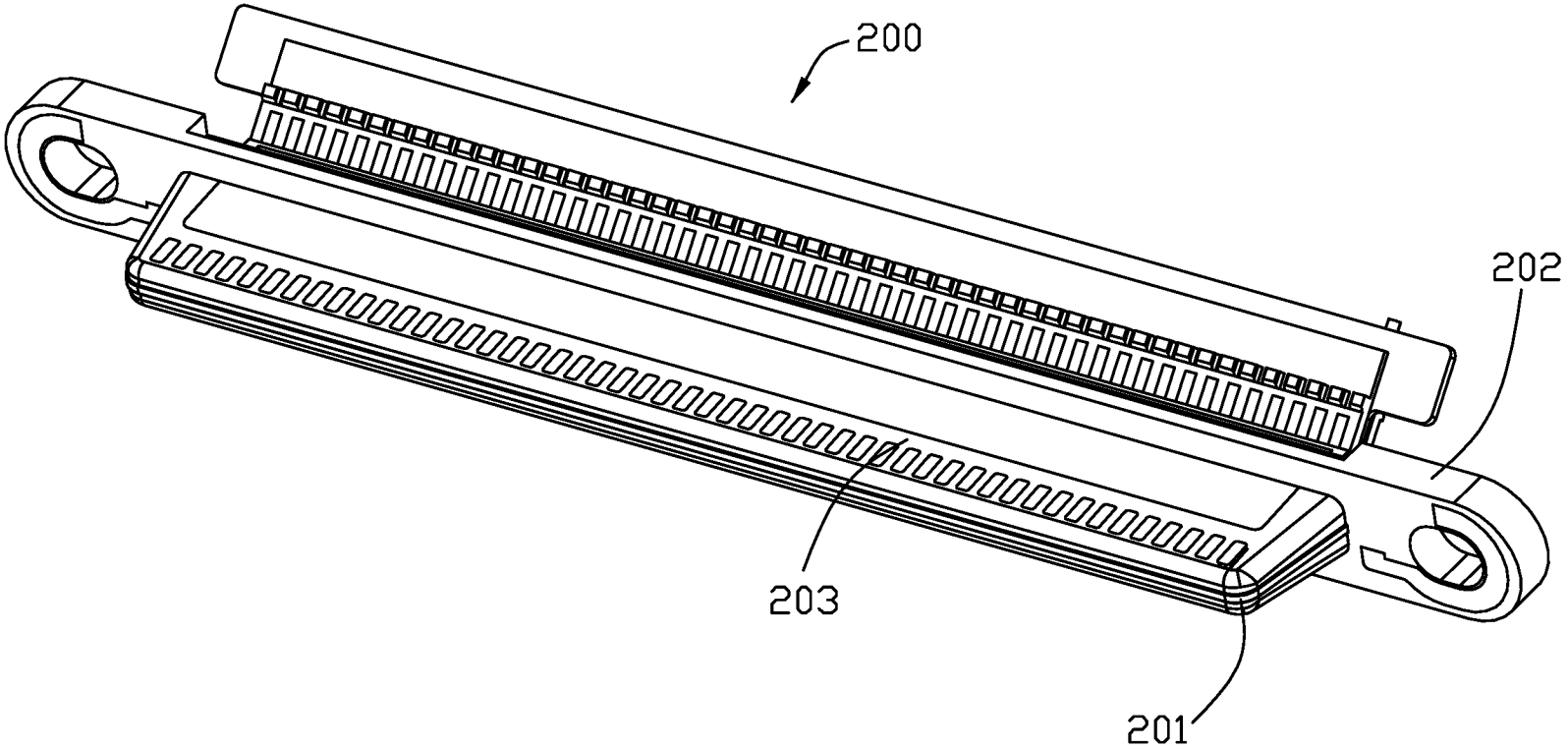
FIG. 10 is a perspective view of a mating connector corresponding to the electrical connector shown in FIG. 1.

Referring to FIG. 10, a mating connector 200 is used to mount on a electronic device for the electrical connector 100 inserted. The mating connector 200 includes an elongated insulative shell, a pair of terminal modules retained in the insulative shell and a shielding plate 201 located between the pair of terminal modules. The insulative shell is directly injection molding on the terminal modules and defines a base portion 202 and a mating portion 203 extending along a mating direction from the front end of the base portion 202. There is a 0.5 mm distance between the outer edges of the shielding plate 201 and the outer edges of the mating portion 203, it is facilitate that the shielding plate 201 is overlapping the elastic contacting arms 3323 and the locking portions 3324 of the shielding member 332 of the electrical connector 100 to form three sides connection, thereby forming a better electromagnetic shielding effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing defining an upper sidewall, a lower sidewall opposite to the upper sidewall and a pair of end walls connected with the upper and lower sidewalls, the upper sidewall, the lower sidewall and the end walls together forming a receiving cavity, each end wall defining a recess communicating with the receiving cavity; and a terminal module retained in the insulative housing and defining a first module, a second module and a shielding member located between the first module and the second module; wherein the shielding member is an integrated structure and defines a shielding portion, a plurality of elastic contacting arms projecting forwardly from the shielding portion and extending laterally, and a pair of locking portions bending into the corresponding recesses from the opposite sides of the shielding portion, the elastic contacting arms and the locking portions are exposed into the receiving cavity of the insulative housing;

wherein the terminal module is assembled to a rear sidewall of the insulative housing and further includes a third module disposed between the first module and the second module, the first module and the second module are separated from each other in a vertical direction, and the shielding member is integrally formed with the third module.

2. The electrical connector as described in claim 1, wherein the third module includes a third insulative block directly injection molded on the shielding member and a pair of grounding plates assembled to the outsides of the third insulative block.

3. The electrical connector as described in claim 2, wherein the shielding portion defines a horizontal shielding portion and a vertical shielding portion extending upwardly from a front of the horizontal shielding portion, the elastic contacting arms are projecting horizontally from a top of the vertical shielding portion and extending laterally, and the locking portions are bending forwardly from opposite sides of the vertical shielding portion.

4. The electrical connector as described in claim 3, wherein the third insulative block is directly injection molded on a rear end of the horizontal shielding portion of the shielding member, the first module and the second module are mounted on a front end of the horizontal shielding portion and disposed in front of the third insulative block.

5. The electrical connector as described in claim 4, wherein each of the first module and the second module includes a plurality of conductive terminals and an insulative block injection molded on the conductive terminals, each insulative block defines a pair of mating portions located on both sides thereof and the mating portions of the first module and the second module are cooperating with each other so as to clamp the third module to form the terminal module.

6. The electrical connector as described in claim 5, wherein each conductive terminal defines a connecting portion retained in the insulative block, a resilient contact portion extending forwardly from the connecting portion and exposed in the receiving cavity, and a tail portion extending outside of the insulative housing from the connecting portion.

7. The electrical connector as described in claim 6, wherein each grounding plate defines a body portion attached to the outside of the third insulating block, a plurality of connecting arms extending forwardly from the body portion and a pair of soldering portions bent and extending from both sides of the body portion, the soldering portions are soldered on the horizontal shielding portion of the shielding member, and the connecting arms are overlapping the tail portions of some conductive terminals of the first and second modules to form grounding terminals.

8. The electrical connector as described in claim 6, wherein the electrical connector includes two grounding bars assembled to the insulative housing, each grounding bar defines a longitudinal base portion and a plurality of resilient arms extending into the insulative housing from the base portion, the base portions are attached to outer surfaces of the upper and lower sidewalls respectively, and the contacting ends of the resilient arms are exposed in the receiving cavity and located in front of the resilient contact portions of the conductive terminals.

9. The electrical connector as described in claim 8, wherein the electrical connector further includes a metal shell surrounding the insulative housing, the grounding bar is located between the insulative housing and the metal shell, and the base portion of the grounding bar is connected with the metal shell.

10. An electrical connector comprising:

an insulative housing including opposite top and bottom walls in a vertical direction, and a pair of opposite side walls in a transverse direction perpendicular to said vertical direction and cooperating with said opposite top and bottom walls to commonly define a receiving cavity;

a plurality of upper contacts disposed in the upper wall with upper contacting sections extending into the receiving cavity, said upper contacts including upper differential pair signal contacts and upper grounding contacts alternately arranged with each other in the transverse direction;

a plurality of lower contacts disposed in the bottom wall with lower contacting sections extending into the receiving cavity, said lower contacts including lower differential pair signal contacts and lower grounding contacts alternately arranged with each other in the transverse direction;

an upper grounding bar disposed around an exterior surface of the top wall and having a plurality of upper resilient arms arranged in the transverse direction, each of said upper resilient arms having a free end extending into the receiving cavity and located in front of and aligned with the corresponding upper grounding contact in a front-to-back direction perpendicular to both vertical direction and said transverse direction;

a lower grounding bar disposed around an exterior surface of the lower wall and having a plurality of lower resilient arms arranged in the transverse direction, each of said lower resilient arms having a free end extending into the receiving cavity and located in front of and aligned with the corresponding lower grounding contact in the front-to-back direction;

wherein said upper contacts are integrally formed with an upper insulator, and said lower contacts are integrally formed with a lower insulator, said upper insulator and said lower insulator being located behind a rear wall of the housing and by two sides of a shielding member having elastic contacting arms extending forwardly through said rear wall and into said receiving cavity;

wherein said shielding member further includes a rear upper grounding bar with connecting arms respectively mechanically and electrically connected to tails of the corresponding upper grounding contacts, and a rear lower grounding bar with connecting arms respectively mechanically and electrically connected to tails of the corresponding lower grounding contacts.

11. The electrical connector as claimed in claim 10, further including a metallic exterior shell intimately enclosing said housing and both said upper grounding bar and lower grounding bar.

12. The electrical connector as claimed in claim 10, wherein said shielding member defines a Z-shaped configuration viewed in the transverse direction, and said upper insulator and said lower insulator are respectively locate on opposite upper and lower sides of the shielding member.

13. The electrical connector as claimed in claim 10, wherein said shielding member unitarily forms a pair of locking portions at two opposite ends of the receiving cavity in said transverse direction.

14. The electrical connector as claimed in claim 10, wherein said shielding member further includes an insulator molded on both surfaces thereof to form a plurality of slots to receive the tails of the corresponding upper contacts and those of the lower contacts, respectively.

15. An electrical connector comprising:

an insulative housing defining a receiving cavity in front of a rear wall;

an upper terminal module and a terminal module sandwiching a shielding member therebetween, said upper terminal module including a plurality of upper contacts integrally formed in an upper insulator and having upper grounding contacts and upper differential pair signal contacts alternately arranged with each other in a transverse direction, said lower terminal module including a plurality of lower contacts integrally formed in a lower insulator and having lower grounding contacts and lower differential pair signal contacts alternately arranged with each other in the transverse direction, said upper insulator and said lower insulator located behind the rear wall, a rear upper grounding bar and a rear lower grounding bar respectively formed on the shielding member;

each of said upper contacts including a contacting section extending through the rear wall and into the receiving cavity, and a tail exposed around a rear end of the upper insulator, each of said lower contacts including a contacting section extending through the rear wall and into the receiving cavity, and tail exposed around a rear end of the lower insulator; wherein the tails of the upper grounding contacts are connected to corresponding connecting arms of the upper grounding bar, and the tails of the lower grounding contacts are connected to corresponding connecting arms of the lower grounding bar; wherein the upper grounding bar and the lower grounding bar are essentially located behind the tails of the upper contacts and those of the lower contacts, respectively.

16. The electrical connector as claimed in claim 15, wherein said shielding member includes a plurality of resilient contacting arm extending forwardly through the rear wall and into the receiving cavity.

17. The electrical connector as claimed in claim 16, wherein said shielding member defines a Z-shaped configuration viewed in the transverse direction, the upper insulator defines another Z-shaped configuration viewed in the transverse direction, and the lower insulator defines an L-shaped configuration viewed in the transverse direction.

* * * * *